US010605265B2

(12) United States Patent
Jin

(10) Patent No.: US 10,605,265 B2
(45) Date of Patent: Mar. 31, 2020

(54) COMPRESSOR

(71) Applicants: Hyundai Motor Company, Seoul (KR); Kia Motors Corporation, Seoul (KR)

(72) Inventor: Seok Beom Jin, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 161 days.

(21) Appl. No.: 15/684,610

(22) Filed: Aug. 23, 2017

(65) Prior Publication Data

US 2018/0274554 A1 Sep. 27, 2018

(30) Foreign Application Priority Data

Mar. 24, 2017 (KR) ..... 10-2017-0037751

(51) Int. Cl.
*F04D 29/46* (2006.01)
*F04D 27/02* (2006.01)
*F04D 29/42* (2006.01)

(52) U.S. Cl.
CPC ..... *F04D 29/462* (2013.01); *F04D 27/0246* (2013.01); *F04D 29/4213* (2013.01)

(58) Field of Classification Search
CPC . F04D 27/0246; F04D 29/4213; F04D 29/462
See application file for complete search history.

(56) References Cited

U.S. PATENT DOCUMENTS

2016/0305453 A1* 10/2016 Burgess ..... F02B 37/12

FOREIGN PATENT DOCUMENTS

KR 10-2010-0054532 A 5/2010
KR 10-2012-0013460 A 2/2012

* cited by examiner

*Primary Examiner* — Jacob M Amick
*Assistant Examiner* — Ruben Picon-Feliciano
(74) *Attorney, Agent, or Firm* — Morgan, Lewis & Bockius LLP

(57) ABSTRACT

A compressor may include a compressor housing integrally provided with a compressor wheel inlet having a surge slit and a choking slit that are sequentially formed along an axial direction of a compressor wheel; a sleeve provided to surround an outer surface of the compressor wheel inlet at an end portion thereof, and linearly moving along the axial direction of the compressor wheel while guiding gas flowing into the compressor wheel; a guide slit provided on the sleeve, and communicating with one of the surge slit and the choking slit in accordance with axial linear movement of the sleeve; and a plurality of vanes provided at a position between an outer circumferential surface of the sleeve and the compressor housing, and configured to change a direction of gas flowing through the surge slit or the choking slit in response to linear displacement of the sleeve.

6 Claims, 10 Drawing Sheets

COMPRESSOR

CROSS REFERENCE TO RELATED APPLICATION

The present application claims priority to Korean Patent Application No. 10-2017-0037751, filed Mar. 24, 2017, the entire contents of which is incorporated herein for all purposes by the present reference.

BACKGROUND OF THE INVENTION

Field of the Invention

The present invention relates generally to a compressor for compressing air and, more particularly, to a compressor configured for being used in a turbocharger or a supercharger mounted on a vehicle.

Description of Related Art

Referring to the performance curve of a centrifugal compressor, surge occurs when the flow rate through the compressor is relatively low and the pressure ratio, which is the ratio of the inlet pressure to the outlet pressure, is relatively high, whereas choking occurs when the flow rate is relatively high and the pressure ratio is relatively low.

In the case of a compressor mounted on a turbocharger, the compressor may enter the surge region or the choking region depending on the driving state of a vehicle (engine speed, load, EGR use, etc.).

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a compressor, being configured for preventing occurrence of surge or choking even when an operating region of the compressor enters a surge region or a choking region in accordance with the driving state of a vehicle, substantially reducing the surge region or the choking region, and thus achieving improved operational stability of the compressor and ultimately contributing to improved output performance of a vehicle.

In various aspects of the present invention, there is provided a compressor, including: a compressor housing integrally provided with a compressor wheel inlet having a surge slit and a choking slit that are sequentially formed along an axial direction of a compressor wheel; a sleeve provided to surround an external surface of the compressor wheel inlet at an end portion thereof, and linearly moving along the axial direction of the compressor wheel while guiding gas flowing into the compressor wheel; a guide slit provided on the sleeve, and communicating with the surge slit or the choking slit depending on an axial linear movement of the sleeve; and a plurality of vanes provided at a position between an external circumferential surface of the sleeve and the compressor housing, and configured to change a direction of gas flowing through the surge slit or the choking slit in response to linear displacement of the sleeve.

Each of the surge slit and the choking slit may be formed in an arc shape such that a plurality of arc-shaped slits are disposed at intervals to be parallel to a virtual plane perpendicular to the axial direction of the compressor wheel.

The guide slit of the sleeve may be formed in an arc shape that is parallel to the plane perpendicular to the axial direction of the compressor wheel, with a width equal to or greater than a larger one of widths of the surge slit and the choking slit.

The vanes may be inclined relative to the axial direction of the compressor wheel, with inclination angles of the vanes being changed in response to the linear displacement of the sleeve.

The sleeve may be provided on the external circumferential surface thereof with a plurality of sleeve protrusions inserted into the vanes, and each of the vanes may be provided with a vane rotation shaft rotatably inserted into an internal surface of the compressor housing, and a linear guide hole formed linearly at a position opposite to the vane rotation shaft such that each of the sleeve protrusions is slidably inserted into the linear guide hole.

The vanes may be inclined relative to the axial direction of the compressor wheel such that inclination directions of the vanes when the guide slit communicates with the surge slit and inclination directions of the vanes when the guide slit communicates with the choking slit are opposite to each other.

The sleeve may be provided on the external circumferential surface thereof with a plurality of sleeve protrusions inserted into the vanes, and each of the vanes may be provided with a vane rotation shaft rotatably inserted into an internal surface of the compressor housing, and a curved guide hole formed curvedly at a position opposite to the vane rotation shaft such that each of the sleeve protrusions is slidably inserted into the curved guide hole.

A guide clip is coupled to each of the vanes at a position opposite to the vane rotation shaft, with the curved guide hole being formed in the guide clip.

According to an exemplary embodiment of the present invention, it is possible to prevent occurrence of surge or choking even when the operating region of the compressor enters the surge region or the choking region in accordance with the driving state of a vehicle, substantially reducing the surge region or the choking region. Thus, it is possible to achieve improved operational stability of the compressor and to ultimately contribute to improved output performance of a vehicle.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
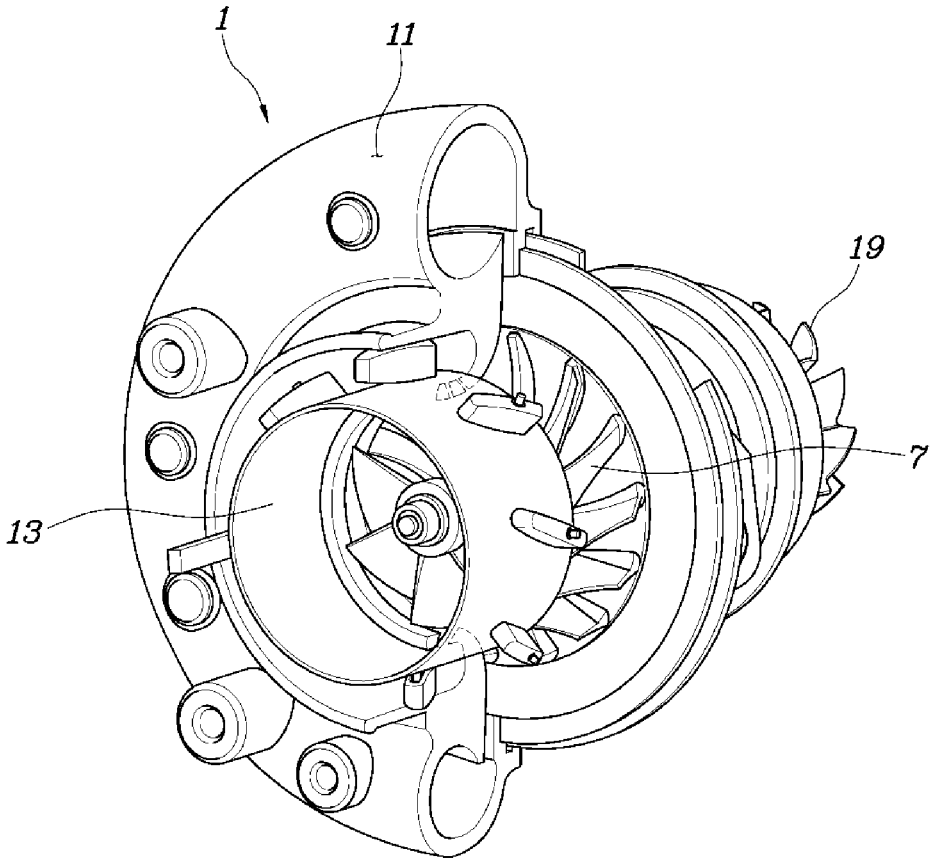
FIG. 1 is a view showing an exemplary embodiment in which a compressor according to an exemplary embodiment of the present invention is applied to a turbocharger.
Figure 2:
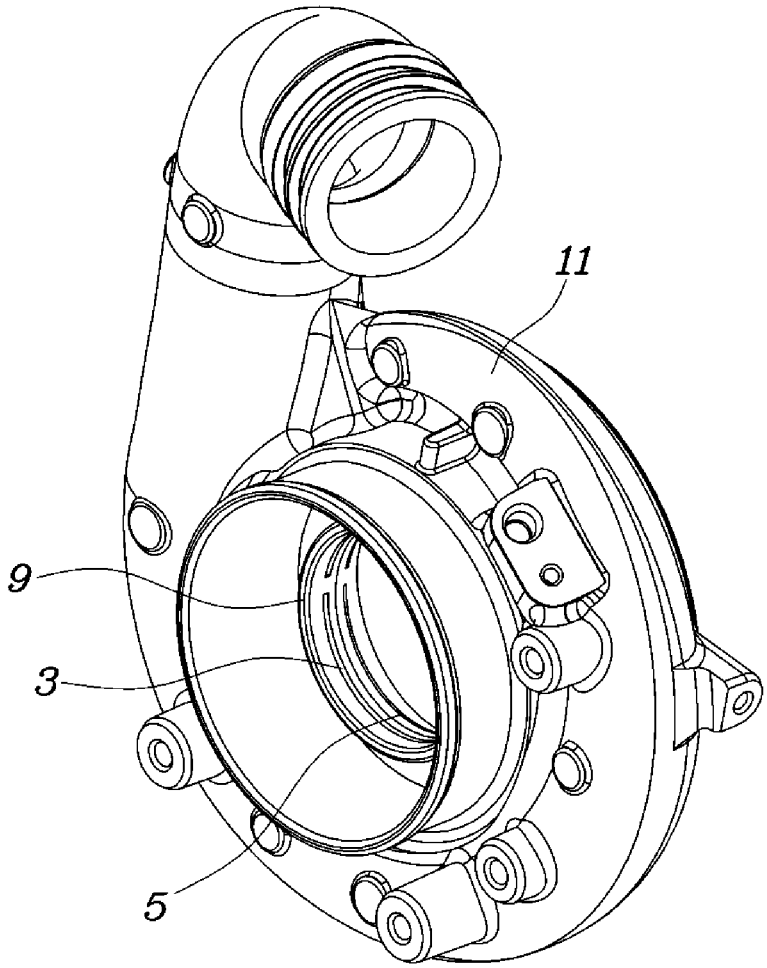
FIG. 2 is a view showing a compressor housing of FIG. 1.
Figure 3:
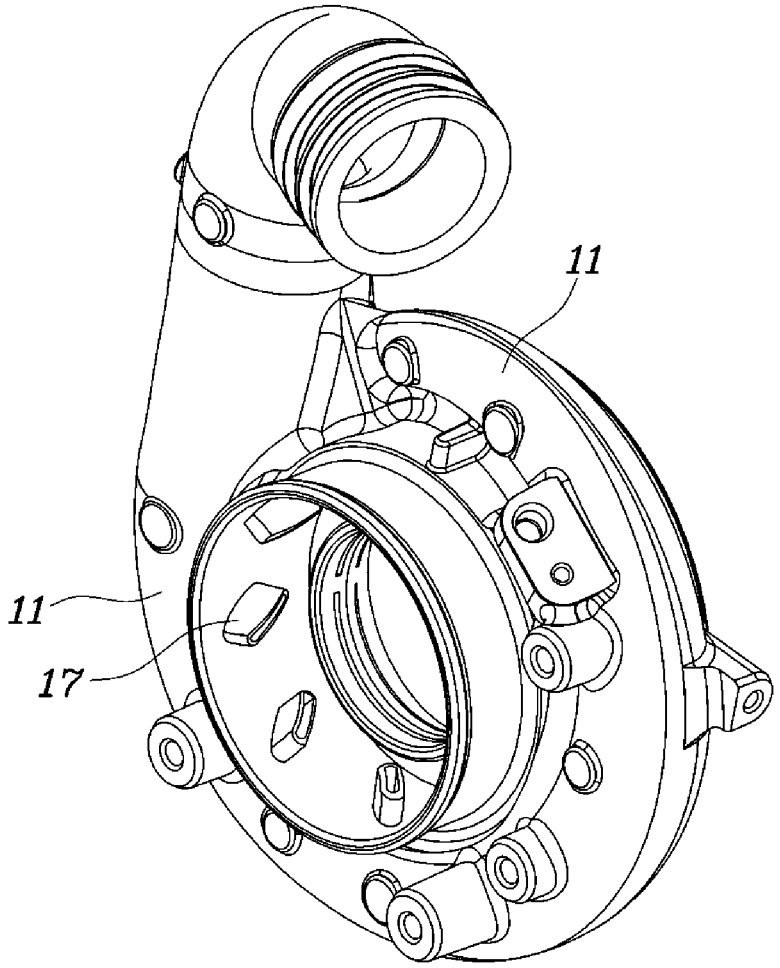
FIG. 3 is a view showing a state where a vane is disposed in the compressor housing.
Figure 4:
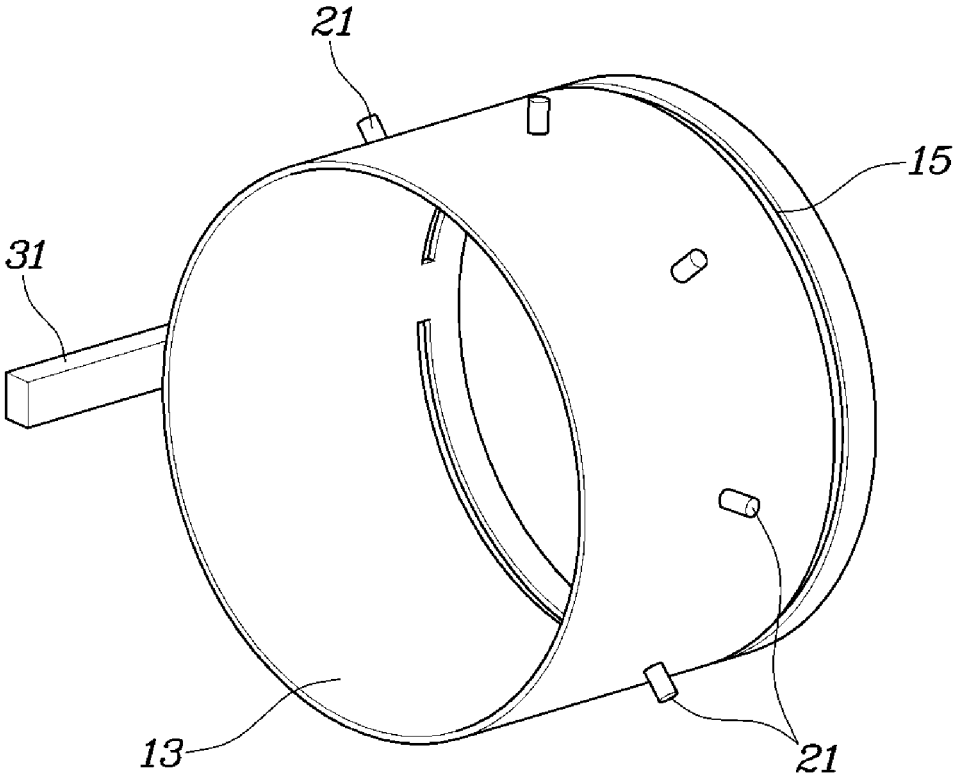
FIG. 4 is a view showing a sleeve.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, exemplary embodiments of the present invention will be described in detail with reference to the accompanying drawings. Throughout the drawings, the same reference numerals will refer to the same or like parts.

Referring to FIGS. 1 to 9, a compressor 1 in an exemplary embodiment of the present invention may include a compressor housing 11 integrally provided with a compressor wheel inlet 9 having a surge slit 3 and a choking slit 5 that are sequentially formed along an axial direction of a compressor wheel 7; a sleeve 13 provided to surround an external surface of the compressor wheel inlet 9 at an end portion thereof, and linearly moving along the axial direction of the compressor wheel 7 while guiding gas introduced into the compressor wheel 7; a guide slit 15 provided on the sleeve 13, and communicating with the surge slit 3 or the choking slit 5 depending on an axial linear movement of the sleeve 13; and a plurality of vanes 17 provided between an external circumferential surface of the sleeve 13 and the compressor housing 11, and configured to change a direction of gas flowing through the surge slit 3 or the choking slit 5 in response to linear displacement of the sleeve 13.

In other words, the present invention realizes a surge-response state in which the guide slit 15 communicates with the surge slit 3 by the axial linear movement of the sleeve 13, and realizes a choking-response state in which the guide slit 15 communicates with the choking slit 5 by the axial linear movement of the sleeve 13, whereby it is possible to perform a surge suppression function or a choking suppression function in a situation where surge or choking may occur. Thus, the effective operating region of the compressor 1 can be expanded.

For reference, a state in which the guide slit 15 is positioned between the surge slit 3 and the choking slit 5, such that both the surge slit 3 and the choking slit 5 are substantially closed will be referred as a neutral state.

Meanwhile, FIG. 1 shows an example in which the compressor 1 of the present invention is connected to a turbine 19 rotated by engine exhaust gas to comprise a turbocharger. However, the compressor 1 of the present invention may also be used in a supercharger driven by a motor without being limited to being used in the turbocharger.

The surge slit 3 and the choking slit 5 are sequentially provided at the compressor wheel inlet 9 surrounding a circumferential external side of the compressor wheel 7 in accordance with a direction of gas flowing into the compressor wheel 7.

Each of the surge slit 3 and the choking slit 5 is formed in an arc shape such that a plurality of arc-shaped slits are disposed at intervals to be parallel to a virtual plane perpendicular to the axial direction of the compressor wheel 7, and the guide slit 15 of the sleeve 13 is formed in an arc shape that is parallel to the plane perpendicular to the axial direction of the compressor wheel 7, with a width equal to or greater than a larger one of widths of the surge slit 3 and the choking slit 5.

Figure 6:
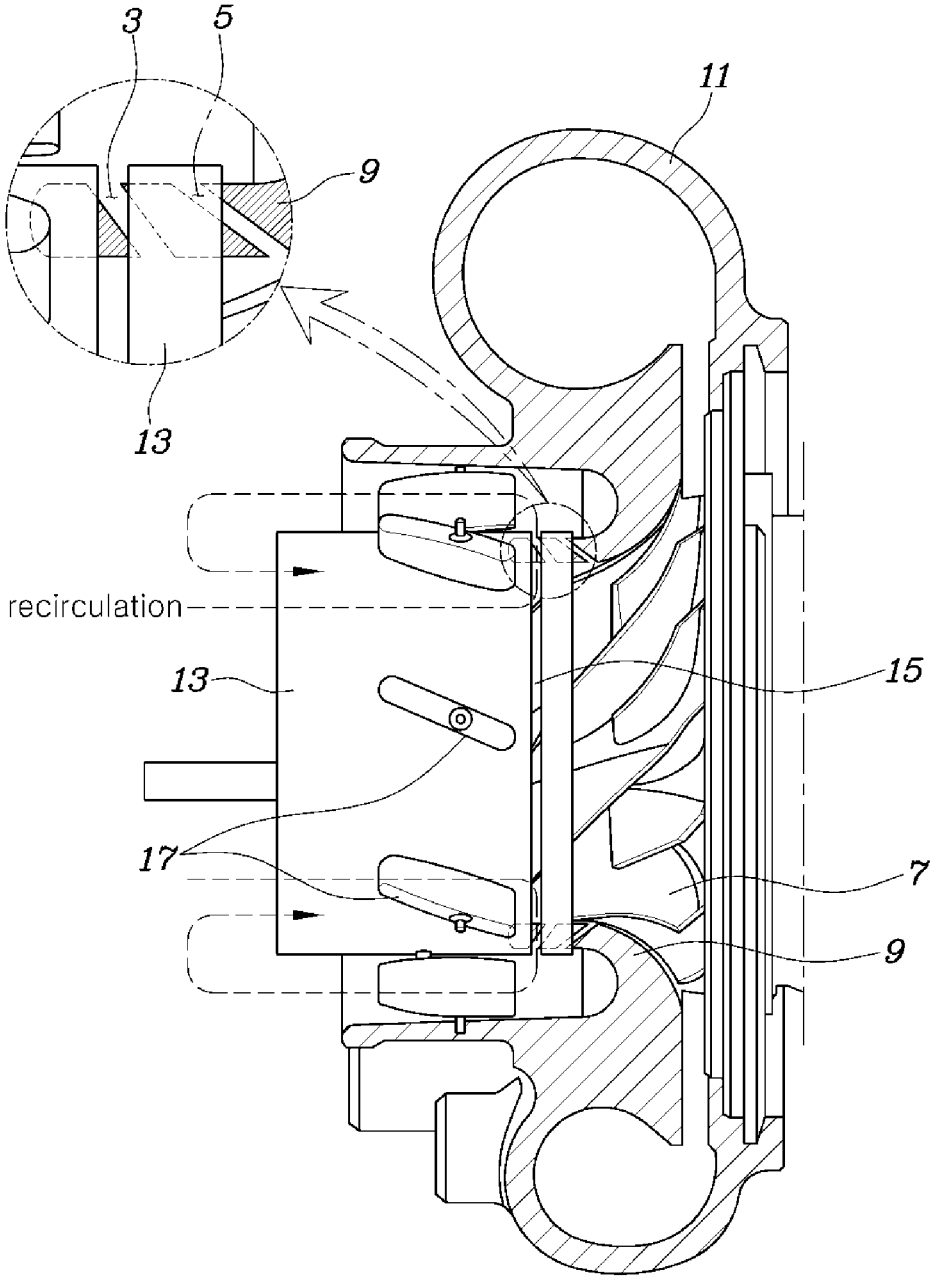
FIG. 6 is a cross-sectional view showing a state in which a guide slit is in communication with a surge slit.
Figure 7:
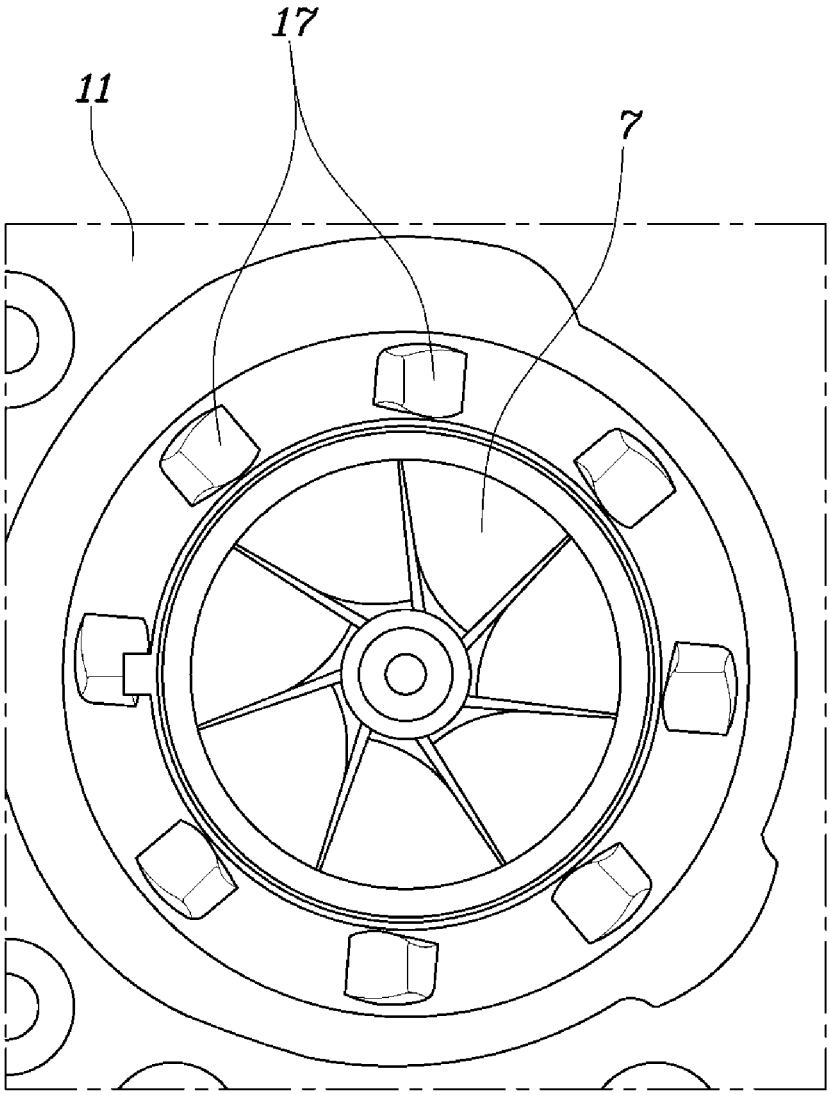
FIG. 7 is a view showing the vane viewed from a left side of FIG. 6.
Figure 8:
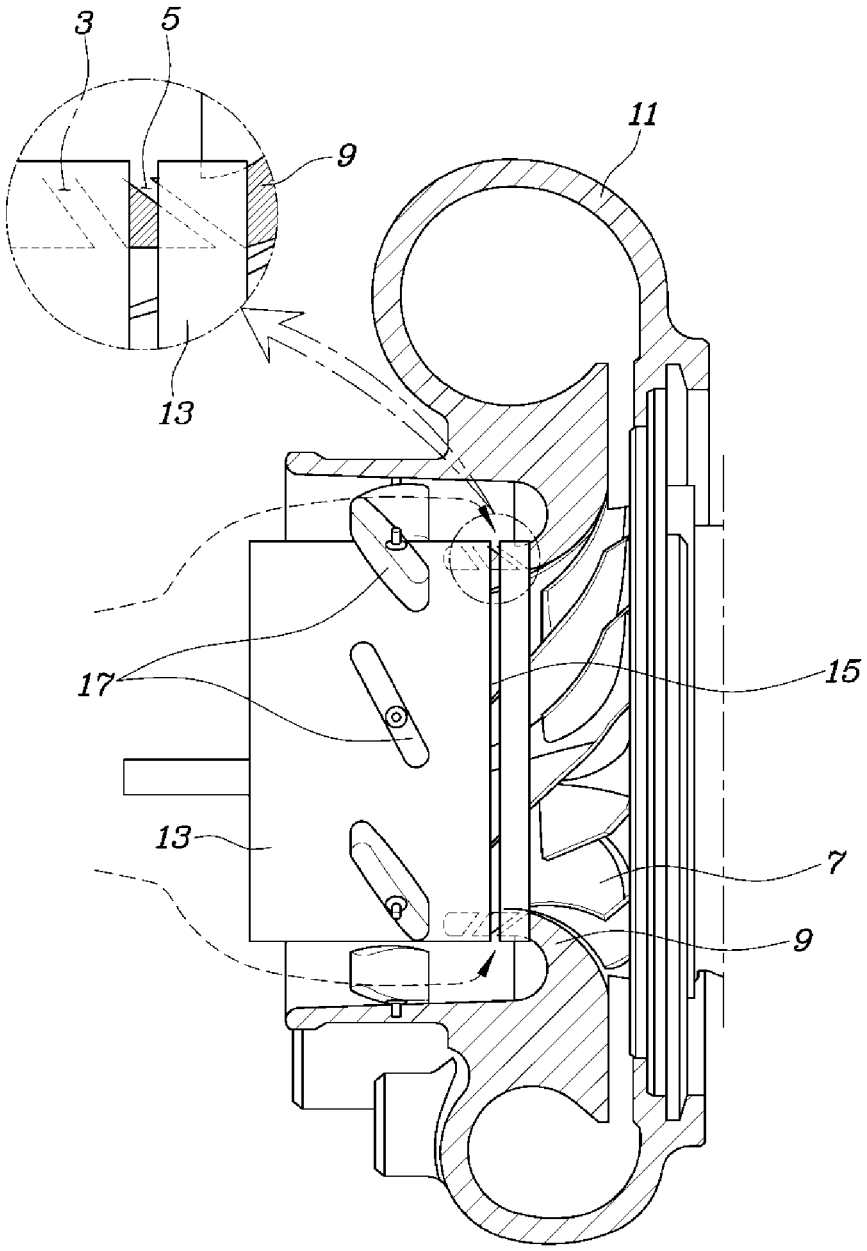
FIG. 8 is a cross-sectional view showing a state in which the guide slit is in communication with a choking slit.
Figure 9:
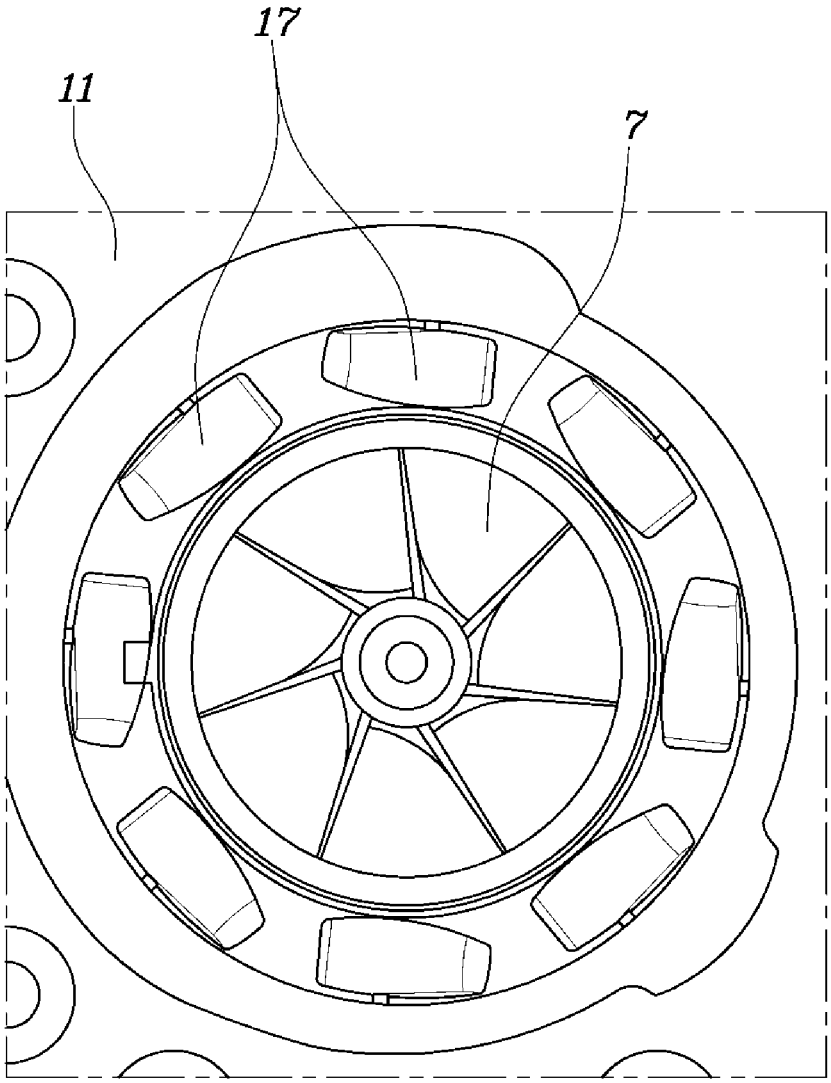
FIG. 9 is a view showing the vane viewed from a left side of FIG. 8.

Accordingly, as shown in FIG. 6, when the sleeve 13 moves linearly away from the compressor wheel 7 from the neutral state, the guide slit 15 communicates with the surge slit 3 such that gas flowing out through the surge slit 3 bypasses the outside of the sleeve 13 and then flows into the sleeve 13 to be re-circulated toward the compressor wheel 7, suppressing surge. As shown in FIG. 8, when the sleeve 13 moves toward the compressor wheel 7 from the neutral state, the guide slit 15 communicates with the choking slit 5 such that gas flowing into a space formed between the compressor housing 11 and the outside of the sleeve 13 flows directly into the compressor wheel 7 through the choking slit 5, suppressing choking.

The vanes 17 may be inclined relative to the axial direction of the compressor wheel 7, with inclination angles of the vanes 17 being changed in response to the linear displacement of the sleeve 13.

Figure 5:
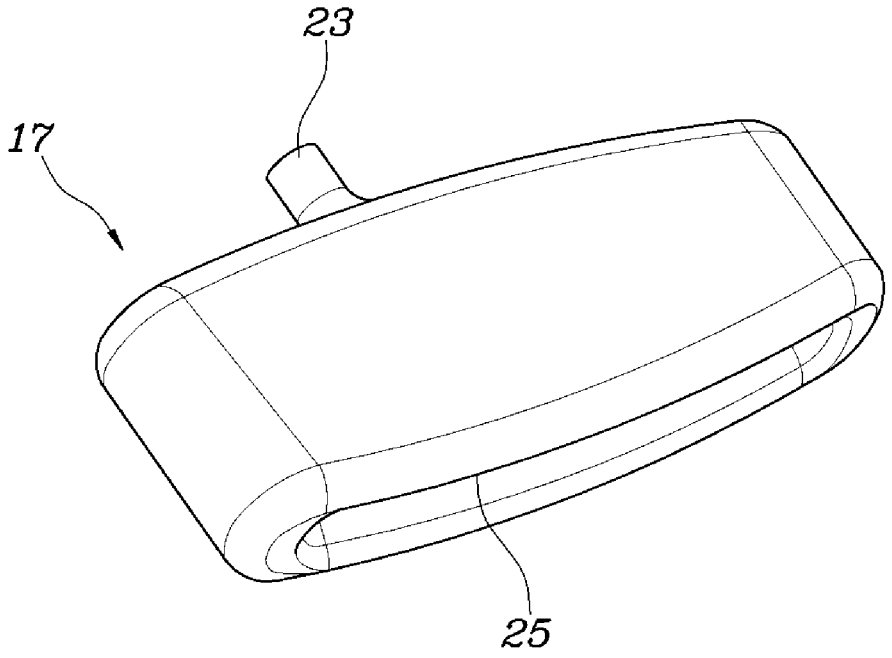
FIG. 5 is a view showing an exemplary embodiment of the vane.

In the present embodiment of the present invention, the sleeve 13 is provided at the external circumferential surface thereof with a plurality of sleeve protrusions 21 inserted into the vanes 17, and as shown in FIG. 5, each of the vanes 5 is provided with a vane rotation shaft 23 rotatably inserted into an internal surface of the compressor housing 11, and a linear guide hole 25 formed linearly at a position opposite to the vane rotation shaft 23 such that each of the sleeve protrusions 21 is slidably inserted into the linear guide hole 25.

Thus, when each of the sleeve protrusions 21 slides in the linear guide hole 25 in response to the linear movement of the sleeve 13, the vanes 17 change from the state of FIG. 6 to the state of FIG. 8, whereby it is possible to change a flow direction of gas re-circulating from the surge slit 3 or gas flowing directly to a turbine wheel through the choking slit 5.

In the instant case, the inclination angles of the vanes 17 in the neutral state will are intermediate between those of the state of FIG. 6 and the state of FIG. 8. At the present time, since both the surge slit 3 and the choking slit 5 are in a closed state, there is no gas flowing around the vanes 17, and thus the vanes 17 do not act as an obstacle.

Here, the inclination angles of the vanes 17 may be changed by the shape and the position of the vane rotation shaft 23 and the linear guide hole 25 of each of the vanes 17, and the sleeve protrusions 21. Thus, the inclination angles of the vanes 17 may be appropriately adjusted to an optimal angle in the surge-response state and the choke-response state by experiment and analysis.

Moreover, the vanes 17 may be inclined relative to the axial direction of the compressor wheel 7, such that inclination directions of the vanes 17 when the guide slit 15 communicates with the surge slit 3 and inclination directions of the vanes 17 when the guide slit 15 communicates with the choking slit 5 are opposite to each other.

To the present end, the sleeve 13 is provided on the external circumferential surface thereof with the plurality of sleeve protrusions 21 inserted into the vanes 17, and each of the vanes 17 is provided with the vane rotation shaft 23 rotatably inserted into the internal surface of the compressor housing 11, and a curved guide hole 25 formed curvedly at a position opposite to the vane rotation shaft 23 such that each of the sleeve protrusions 21 is slidably inserted into the curved guide hole 25.

Figure 10:
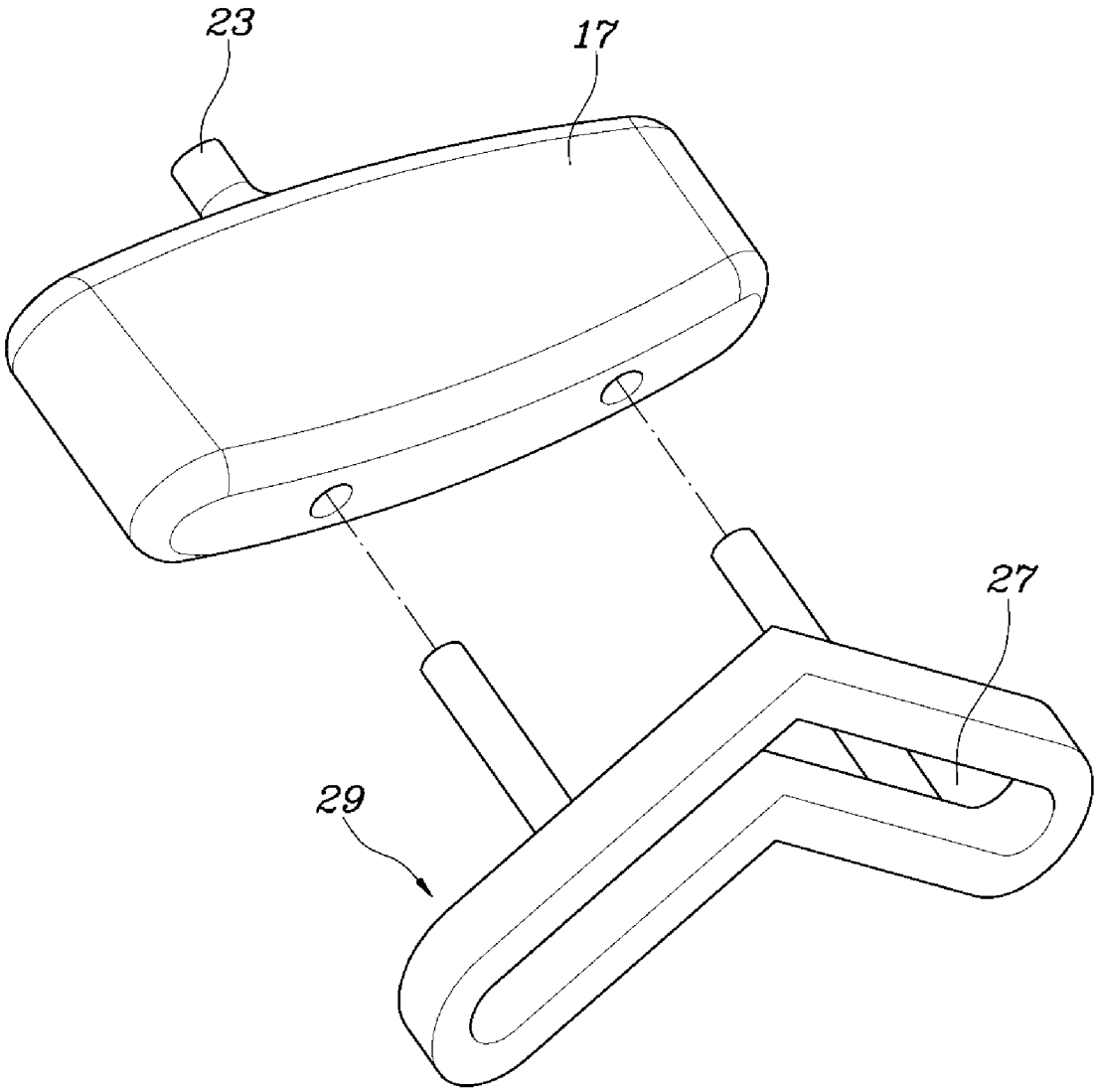
FIG. 10 is a view showing another exemplary embodiment of the vane.

In an exemplary embodiment of FIG. 10, a guide clip 29 is coupled to each of the vanes 17 at a position opposite to the vane rotation shaft 23, with the curved guide hole 27 being formed in the guide clip 29. Of course, without providing the guide clip 29 separately, the curved guide hole 27 may be formed integrally or monolithically with each of the vanes 17 at the position opposite to the vane rotation shaft 23.

When the vanes 17 as shown in the exemplary embodiment of FIG. 10 are used, the sleeve protrusions 21 slidably move through central curved portions of the curved guide holes 27 of the vanes 17 in response to the linear movement of the sleeve 13. Accordingly, in the surge-response state and the choking-response state, the vanes 17 are rotated in opposite directions with respect to the axial direction of the compressor wheel 7.

In the instant case, inclination directions of the vanes 17 are opposite to twisting directions of blades of the compressor wheel 7 in the surge-responsive state, and inclination directions of the vanes 17 are equal to the twisting directions of the blades of the compressor wheel 7 in the choking-response state. Accordingly, the inclination angles of the vanes 17 form an optimal gas flow in the surge-response state and the choking-response state, efficiently suppressing surge and choking. Thus, it is possible to obtain an effect of further expanding the effective operating region of the compressor 1.

For reference, the sleeve 13 of the present embodiment is integrally provided with an operating rod 31 receiving operating force for linearly moving the sleeve 13 along the axial direction, so that various actuators configured for generating linear displacement of the sleeve 13 may be connected to the operating rod 31. Here, a motor, a hydraulic or pneumatic cylinder or the like may be connected to the actuator, and the sleeve 13 may be directly connected to the actuator without the actuating rod 31.

Thus, a controller for controlling an engine controls the actuator in accordance with the operation state of the engine or the compressor 1 to linearly move the sleeve 13, suppressing surge or choking. As a result, it is possible to expand the effective operating region of the compressor 1.

For reference, surge or choking is suppressed by the flow of gas via the surge slit 3 or the guide slit 15, which is based on the principle already known in the art, and thus detailed description will be omitted.

Although an exemplary embodiment of the present invention has been described for illustrative purposes, those skilled in the art will appreciate that various modifications, additions and substitutions are possible, without departing from the scope and spirit of the invention as disclosed in the accompanying claims.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A compressor, comprising:

a compressor housing integrally provided with a compressor wheel inlet having a surge slit and a choking slit that are sequentially formed along an axial direction of a compressor wheel;

a sleeve provided to surround an external surface of the compressor wheel inlet at an end portion thereof; and linearly moving along the axial direction of the compressor wheel while guiding gas flowing into the compressor wheel;

a guide slit provided on the sleeve, and communicating with the surge slit or the choking slit depending on an axial linear movement of the sleeve; and a plurality of vanes provided at a position between an external circumferential surface of the sleeve and the compressor housing, and configured to change a direction of gas flowing through the surge slit or the choking slit in response to the linear displacement of the sleeve, wherein the vanes are inclined relative to the axial direction of the compressor wheel, with inclination angles of the vanes being changed in response to the linear displacement of the sleeve, wherein the sleeve is provided on the external circumferential surface thereof with a plurality of sleeve protrusions inserted into the vanes, wherein each of the vanes is provided with a vane rotation shaft rotatably inserted into an internal surface of the compressor housing, and a linear guide hole formed linearly at a position opposite to the vane rotation shaft, and wherein each of the sleeve protrusions is slidably inserted into the linear guide hole.

2. The compressor of claim 1, wherein each of the surge slit and the choking slit is formed in an arc shape, and wherein a plurality of arc-shaped slits are disposed at intervals to be parallel to a virtual plane perpendicular to the axial direction of the compressor wheel.

3. The compressor of claim 2, wherein the guide slit of the sleeve is formed in an arc shape that is in parallel to a plane perpendicular to the axial direction of the compressor wheel, with a width equal to or greater than a larger one of widths of the surge slit and the choking slit.

4. The compressor of claim 1, wherein the vanes are inclined relative to the axial direction of the compressor wheel, and wherein inclination directions of the vanes when the guide slit communicates with the surge slit and inclination directions of the vanes when the guide slit communicates with the choking slit are opposite to each other.

5. The compressor of claim 4, wherein the sleeve is provided on the external circumferential surface thereof with a plurality of sleeve protrusions inserted into the vanes, and each of the vanes is provided with a vane rotation shaft rotatably inserted into an internal surface of the compressor housing, and a curved guide hole formed curvedly at a position opposite to the vane rotation shaft, and wherein each of the sleeve protrusions is slidably inserted into the curved guide hole.

6. The compressor of claim 5, wherein a guide clip is coupled to each of the vanes at a position opposite to the vane rotation shaft, with the curved guide hole being formed in the guide clip.

* * * * *